US005700591A

United States Patent [19]

Okajima et al.

[11] Patent Number: 5,700,591

[45] Date of Patent: Dec. 23, 1997

[54] LIGHT-EMITTING THIN FILM AND THIN FILM EL DEVICE

[75] Inventors: Michio Okajima, Neyagawa; Takao Tohda, Ikoma, both of Japan

[73] Assignee: Matsushita Electric Industrial Co., Ltd., Kadoma, Japan

[21] Appl. No.: 216,853

[22] Filed: Mar. 23, 1994

Related U.S. Application Data

[63] Continuation of Ser. No. 665,799, Mar. 8, 1991, abandoned.

[30] Foreign Application Priority Data

| | | | |
|---|---|---|---|
| Mar. 14, 1990 | [JP] | Japan | 2-063152 |
| Mar. 28, 1990 | [JP] | Japan | 2-079449 |
| Oct. 2, 1990 | [JP] | Japan | 2-265654 |
| Oct. 22, 1990 | [JP] | Japan | 2-285640 |

[51] Int. Cl.[6] ..... H05B 33/00

[52] U.S. Cl. ..... 428/690; 428/691; 428/917; 313/503; 313/506; 313/509

[58] Field of Search ..... 422/690, 917, 422/691; 313/503, 509, 506

[56] References Cited

U.S. PATENT DOCUMENTS

| | | | |
|---|---|---|---|
| 4,717,858 | 1/1988 | Tanaka et al. | 313/509 |
| 4,751,427 | 6/1988 | Barrow et al. | 313/503 |
| 4,769,292 | 9/1988 | Tang et al. | 428/690 |
| 4,869,973 | 9/1989 | Nishikawa et al. | 428/690 |

FOREIGN PATENT DOCUMENTS

| | | | |
|---|---|---|---|
| 0258888 | 3/1988 | European Pat. Off. . | |
| 258888 | 3/1988 | European Pat. Off. | H05B 33/22 |

OTHER PUBLICATIONS

Huheey, James E., *Inorganic Chemistry*, 3rd Ed.; "Band Theory" pp. 195–203, Harper & Row, Publisher New York, 1983.

American Institute of Physics Handbook, Third Edition pp. 9:16–25, McGraw–Hill Book Co., 1983.

A.G. Fischer, "Electroluminescent Lines in ZnS Powder Particles", Journal of the Electrochemical Society, Jul. 1963, pp. 733–747.

Okajima et al, "Heteroepitaxial Growth of MnS on GaAs Substrates", Reprinted from Journal of Crystal Growth, 117, 1992 pp. 810–815.

A.G. Fischer, "Electrolyminescence in II–VI Compounds", Luminescence of Inorganic Solids, Edited by Paul Goldberg, Acadenic Press, 1966, pp. 541–559.

Fonash, Solar Cell Device Physics, Academic Press, 1981, pp. 76–81.

Patent Abstracts of Japan, vol. 3, No. 81 (E–122) 12 Jul. 1979.

Suyama et al, "New Type of Thin–Film Electroluminescent Device Having a Multilayer Structure", Applied Physics Letters, vol. 41, No. 5, Sep. 1982, pp. 462–464.

*Primary Examiner*—Charles Nold

*Attorney, Agent, or Firm*—Cushman, Darby &Cushman IP Group of Pillsbury Madison & Sutro LLP

[57] ABSTRACT

A phosphor thin film of a compound of zinc, cadmium, manganese or alkaline earth metals and an element of group VI is sandwiched by barrier layers having a larger energy gap than that of the phosphor thin film, and a plurality of the sandwich structures are accumulated thicknesswise to constitute a light-emitting device. The phosphor thin film ensures the confinement of injected electrons and holes within the phosphor thin film. The light-emitting device has a high brightness and a high efficiency.

15 Claims, 4 Drawing Sheets

LIGHT-EMITTING THIN FILM AND THIN FILM EL DEVICE

This is a continuation of application Ser. No. 07/665,799, filed on Mar. 8, 1991, which was abandoned upon the filing hereof.

BACKGROUND OF THE INVENTION

1. Field of the Invention

The present invention relates to light-emitting thin films which emit light of such as red, green, or blue and relates to thin film electroluminescent (herein after, abbreviated as EL) devices utilizing those films.

2. Description of the Prior Art

In recent years, as for the flat-type display apparatus to be used in such as computer terminal displays, thin film EL devices have been investigated and developed intensively. Particularly, monochromatic (yellowish orange) thin film EL displays utilizing a phosphor thin film comprising manganese-added zinc sulfide are already put into actual applications.

Furthermore, it is considered to be inevitable that the general development trend of such the monochromatic display is now directed toward the color display. Therefore much effort has been spent on developing phosphor materials for EL use that are capable of emitting three primary colors of red, green and blue. Among these, intensive researches have been done on ZnS:Tm or SrS:Ce or the like as the blue phosphor material; ZnS:Sm or CaS:Eu or the like as the red phosphor material, and ZnS:Tb or CaS:Ce or the like as the green phosphor material.

On the other hand, in the field of light-emitting diodes (LED), aiming at the full-color display, research efforts for bringing the LED's to a shorter wavelength region have been actively tried. Also trials of obtaining a high-brightness blue LED have been made by forming a PN-Junction or a MIS-junction employing semiconductor materials having wide band gaps, such as SiC, GaN, ZnS. ZnSe, or others.

Heretofore, however, in those thin films which emit lights of red, green and blue three primary colors, there are still problems on their brightness and efficiency for red and green, while there are another problem of color purity for blue. These problems hinder these thin films from being used in actual color EL panels. Hence, today, no color EL panel has been put into actual applications yet.

Meanwhile, for the LED's, for red color, sufficiently high-brightness light-emitting devices are already put into practical applications but, for green and blue, they are still insufficient for practical applications.

Furthermore, there is not yet realized any solid-state light-emitting device having its emission wavelength range in still shorter wavelength region, that is, in the UV range. The present invention has been made in consideration of the above-mentioned problems of the conventional light-emitting thin films and thin film EL devices of prior art, and it purposes to offer a high brightness and high efficiency light-emitting thin film and thin film EL devices that are capable of emitting lights of shorter wavelength region.

Also, the present invention is concerned with a light-emitting thin film in which a plural number of composite structures are laminated.

OBJECT AND SUMMARY OF THE INVENTION

A light-emitting thin film in accordance with the present invention has a structure wherein a phosphor thin film of a thickness of from 1 nm to 50 nm is sandwiched by barrier layers composed of a material having an energy gap which is greater than that of the above-mentioned phosphor thin film.

Owing to this structure, electrons and holes injected or generated with a high electric field are confined within the phosphor thin film. As a consequence of this confinement, electrons and holes efficiently recombine directly or through recombination centers within the phosphor thin film. Thereby phosphor materials that have widely been used for CRT screens or for fluorescent lamps can be used as materials for the phosphor thin film, enabling us to form a light-emitting thin film having a high light-emitting brightness and a high efficiency.

And, also owing to this structure, as for the phosphor thin film, a material having a sufficiently wide band gap to emit lights in a shorter wavelength region can be used. This is possible by using, as a material of the barrier layers, such materials that include, as a main component, at least one compounds selected from the group consisting of zinc, cadmium, manganese, or alkaline earth metals and element of group VI, or such materials which includes a fluorides of alkaline earth metals. This is because that all of these compounds and materials have wider energy gaps than that of the phosphor thin film. Therefore, electrons and holes are confined sufficiently within the above-mentioned phosphor thin film, hence making electrons and holes efficiently recombine. Thereby it becomes possible to realize a short-wavelength light-emitting device having a high light-emitting brightness and a high efficiency.

Furthermore, by employing materials having the identical crystal structure both for the above-mentioned phosphor thin film and for the barrier layers, such crystal lattice defects as dangling bonds acting as a non-radiative centers, which are apt to appear on the interfaces across those thin film and the barrier layers, are reduced. Therefore, the rate of non-radiative recombination between generated electrons and holes is lowered and hence the light-emitting brightness as well as the efficiency are raised.

Experiments show that, when plural number of phosphor thin films are used in the laminated light-emitting layer the light emission was strong, whereas when a single layered the phosphor thin film was used as the light-emitting layer the intensity of the light emission was less than the above-mentioned case using the plural number of phosphor thin film although the light emission started at a lower voltage.

Furthermore, experiments show that when the thickness of the phosphor thin film was thicker than 50 nm the confinement effect of electrons and holes became insufficient and the light emission intensity was lowered, whereas when the thickness of the phosphor thin film was thinner than 1 nm the lattice defects increased and the density of light emission centers or recombination centers decreased hence lowering the light emission intensity. Still furthermore, the experiments show that when the phosphor thin film and the barrier layer are of the same crystal structure a better light emission characteristics are observed than the cases that they are of different crystal structure. This was true not only for the cases that the crystal structures of the phosphor thin film and the barrier layer were zinc blende, but also for the cases that they were rock salt type. And for the barrier layers and the phosphor thin films, at least, epitaxial films can provide better light emission characteristics.

it will be recognized that some or all of the Figures are schematic representations for purposes of illustration and do not necessarily depict the actual relative sizes or locations of the elements shown.

DESCRIPTION OF THE PREFERRED EMBODIMENTS

In the following, the present invention is elucidated on embodiments to be described below referring to drawings.

[First Embodiment]

Figure 1:
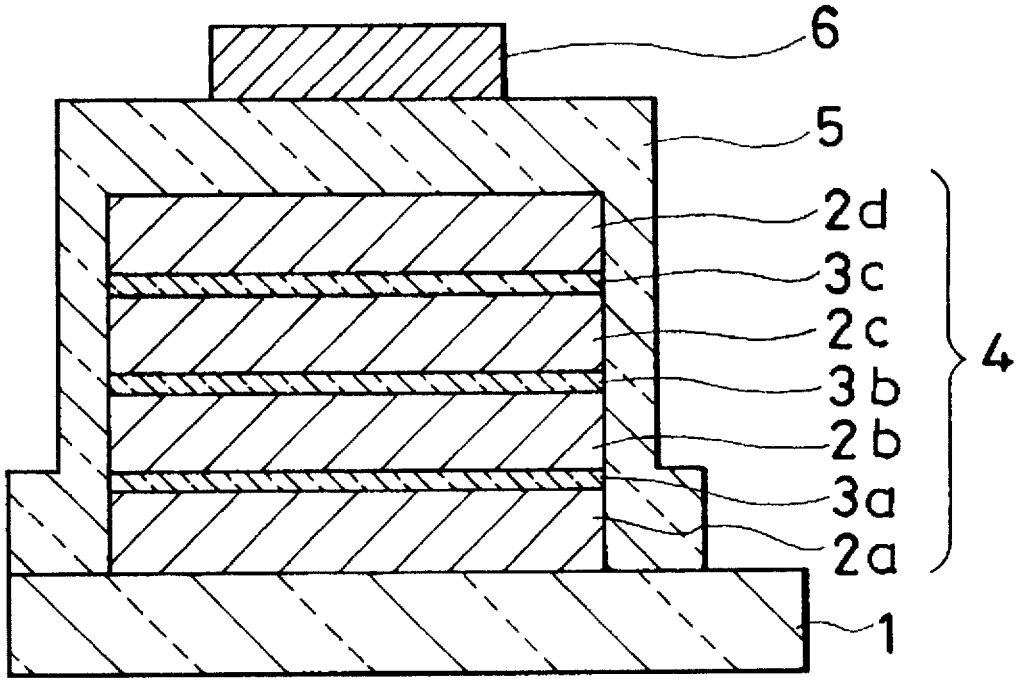
FIG. 1 is a cross-sectional drawing showing a first embodiment of a thin film EL device in accordance with the present invention.

FIG. 1 is a cross-sectional drawing showing a first embodiment of a thin film EL device in accordance with the present invention.

On a GaAs substrate 1, a barrier layer 2a composed of a CaS thin film of a thickness of 200 nm is formed by the epitaxial growth using an electron beam evaporation method. Thereover, using three Knudsen cells respectively containing ZnS, CdS, and Ag, a phosphor thin film 3a composed of $Zn_{0.7}Cd_{0.3}S$:Ag of a thickness of 20 nm is formed by the epitaxial growth. Furthermore, thereover, a barrier layer 2b composed of CaS of a thickness of 200 nm, a phosphor thin film 3b composed of $Zn_{0.7}Cd_{0.3}S$:Ag of a thickness of 20 nm, a barrier layer 2c composed of CaS of a thickness of 200 nm, a phosphor thin film 3c composed of $Zn_{0.7}Cd_{0.3}S$:Ag of a thickness of 20 nm, and a barrier layer 2d composed of CaS of a thickness of 200 nm are successively grown by the epitaxial growth. Thus, a laminated light-emitting layer 4 as a laminated structure is formed. Then, thereover $BaTa_2O_6$ ceramics is rf-spattered in an argon atmosphere including 10% oxygen. Thereby a dielectric thin film 5 of a thickness of 300 nm is formed. Further, thereover, a transparent electrode 6 composed of ITO of a thickness of 200 nm is formed by the electron beam evaporation method.

The thin film EL device of the present embodiment was driven by applying an AC voltage of a pulse width of 30 μs, a repetition frequency of 1 kHz, and a peak voltage of 200 V across the substrate 1 and the transparent electrode 6, and it emitted bright green light. And, by replacing the luminescent impurity from Ag to Cu, it emitted bright red light.

[Second Embodiment]

Figure 2:
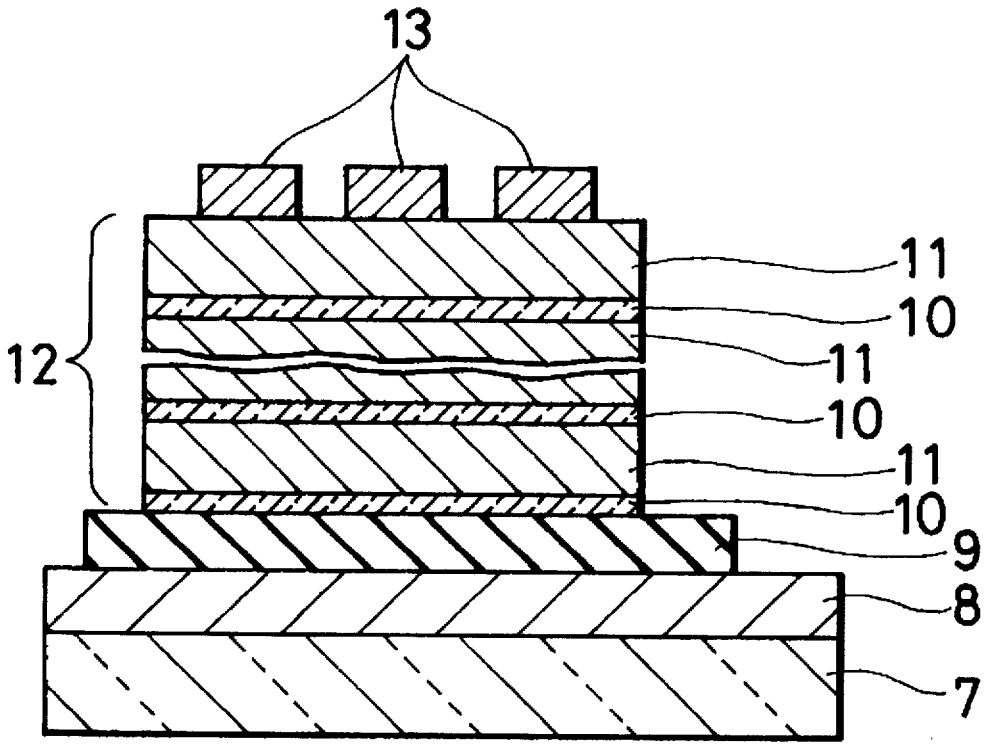
FIG. 2 is a cross-sectional drawing showing a second embodiment of a thin film EL device in accordance with the present invention.

FIG. 2 is a cross-sectional drawing showing a second embodiment of a thin film EL device in accordance with the present invention.

On a glass substrate 7, a transparent electrode 8 composed of an ITO thin film of a thickness of 200 nm is formed by the electron beam evaporation growth. Thereover, a dielectric thin film 9 composed of $CaF_2$ of a thickness of 200 nm is formed by the electron beam evaporation growth. Then, thereover, a phosphor thin films 10 composed of ZnS:Tm of a thickness of 10 nm, and a barrier layers 11 composed of $CaF_2$ of a thickness of 20 nm both of which are formed by the electron beam evaporation growth, are laminated alternately as many as 30 layers, and thus a laminated light-emitting layer 12 is formed. Furthermore, thereover, a back electrode 13 composed of aluminum of a thickness of 200 nm is formed by the electron beam evaporation growth.

The thin film EL device of the present embodiment was driven by applying an AC voltage of a pulse width of 30 μs, a repetition frequency of 1 kz, and a peak voltage of 200 V across the transparent electrode 8 and the back electrode 13, and it emitted bright blue light.

As for the material for the phosphor thin film, besides zinc sulfide described in the above-mentioned embodiment, usable substances are cadmium sulfide, zinc telluride, zinc selenide, cadmium-zinc sulfide, or a material including a mixed crystal of the above-mentioned materials as a main composition. They can exhibit the same effect as in zinc sulfide, since, the energy gap of these materials, which are used for the barrier layer are wide enough to exceed the energy gap of the material used for the phosphor thin film. Apart from the first and second embodiments wherein the phosphor thin film includes a luminescent impurity, it is also possible to use a phosphor thin film which does not include impurity, depending upon the necessity. As for the combination of the materials used for the phosphor thin film and for the barrier layers, combinations of materials having nearly the same lattice constant can give an excellent result. This holds similarly also for other embodiments. For example, in case that ZnS is employed as the material of phosphor thin film 10 as In the present embodiment, the light-emitting efficiency increases when mixed crystal of strontium-calcium fluoride having a composition ratio matching in lattice with the above-mentioned phosphor thin film is used for the barrier layers 11. Hereupon, it is desirable that the difference between the lattice constant of the above-mentioned phosphor thin film and that of the barrier layers is within 5% or less.

Figure 3:
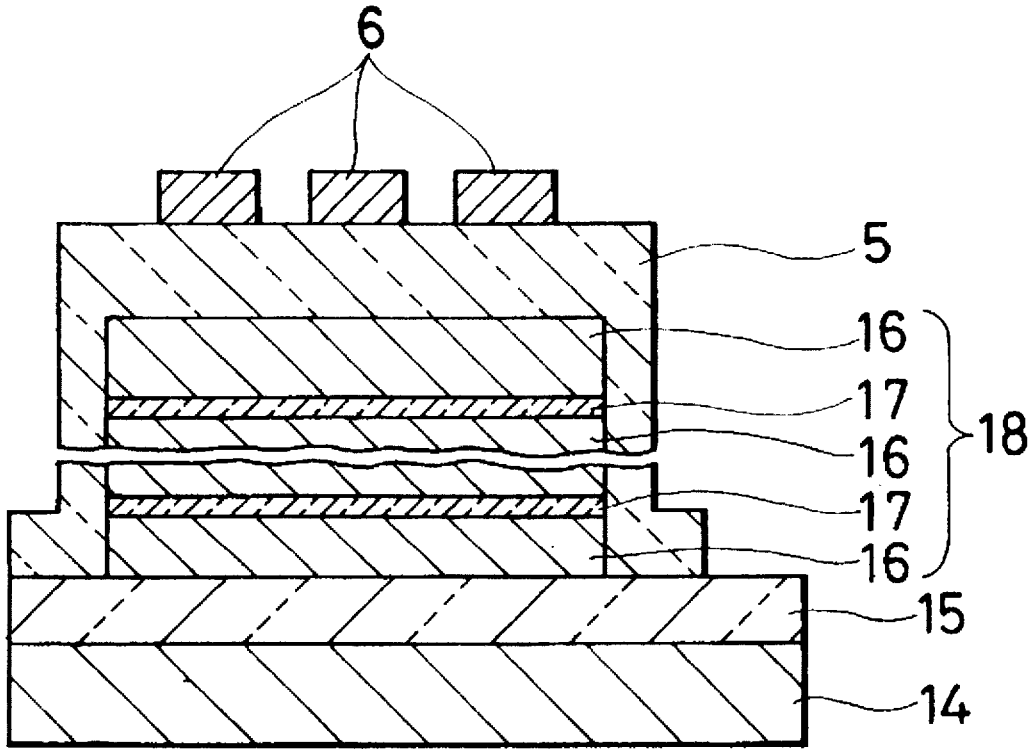
FIG. 3 is a cross-sectional drawing showing a third embodiment of a thin film EL device in accordance with the present invention.

FIG. 3 is a cross-sectional view showing a third embodiment of a thin film EL device in accordance with the present invention.

On a low-resistance Si substrate 14, a dielectric film 15 composed of a $CaF_2$ thin film of a thickness of 150 nm is grown epitaxially by the molecular beam epitaxial growth technique. Thereover, using Knudsen cells respectively containing Ca and Mg and a hydrogen sulfide gas cell, a barrier layers 16 composed of a $Ca_{0.6}Mg_{0.4}S$ of a thickness of 70 nm is formed. On the barrier layers 16, a phosphor thin film 17 composed of ZnS of a thickness of 10 nm is formed by the epitaxial growth. Similarly, thereover, a barrier layers composed of a $Ca_{0.5}Mg_{0.4}S$ and a phosphor thin film composed of ZnS are alternately grown by the epitaxial growth until 10 periods (10 repetitions or alternations) are completed. Finally, a barrier layer 16 is formed by the epitaxial growth. Thus a laminated light-emitting layers 18 of a thickness of 870 nm is constituted. And, thereover, likewise in the first embodiment, a dielectric thin film 5 composed of $BaTa_2O_6$ of 200 nm thickness is formed. Furthermore, thereover, a transparent electrode 6 composed of ITO of a thickness of 200 nm is formed by the electron beam evaporation method. Thus a thin film EL device is completed.

Apart from the present embodiment wherein a dielectric thin film S and another dielectric thin film 15 are formed in a gap between the Si substrate 14 and the laminated light-emitting layer 18 and in the other gap between the laminated light-emitting layer 18 and the transparent electrode 6, respectively, the dielectric thin film may be formed only in either one gap for the same role.

When the thin film EL device of the present embodiment was driven by applying an AC voltage of a pulse width of 30

μs, a repetition frequency of 1 kHz, and a peak voltage of 150 V across the substrate 14 and the transparent electrode 6, it emitted ultraviolet light of wavelength of 350 nm 380 nm.

Any material including mixed crystal of magnesium sulfide and sulfides of other alkaline earth metals represented by $Ca_{0.6}Mg_{0.4}S$ which was used as a barrier layer material in the third embodiment and a sulfide of other alkaline earth metal as its main composition has a wide band gap of typically 3.8 to 5.4 eV, with the widest one of 5.4 eV of MgS. Since these band gaps are wide enough exceeding the 3.5 eV band gap of ZnS employed in the phosphor thin film, carriers can be efficiently confined within the phosphor thin film. By the use of material composition of the present embodiment, the lattice matching between respective layers is achievable. Thereby the lattice defect, which is one of various causes for producing non-radiative centers, can be reduced in comparison with those cases Including lattice mismatching. Hence the light-emission efficiency becomes high. In the present embodiment, ZnS was employed as a phosphor thin film, and therefore, Si and $CaF_2$ which have close lattice constants to that of ZnS were used, as the substrate material as well as the dielectric thin film 15. Also for achieving the lattice matching with respect to the barrier layer material, a mixed crystal of MgS and CaS was used. It is also possible to make the dielectric thin film 15 perfectly lattice-matched with ZnS phosphor thin film. In that case, similarly as in the second embodiment, mixed crystals of strontium-calcium fluoride can be used. The band gap of calcium-magnesium sulfide in the case of holding the lattice matching with the ZnS phosphor thin film becomes as sufficiently wide as about 4.8 eV. Thereby both electrons and holes are confined within the phosphor thin film, and a highly efficient light-emission is obtained.

Apart from the third embodiment, wherein Si has been used as a substrate material, the same effect was also obtained by the use of, for example, GaP which has a lattice constant close to that of Si. Also, although a mixed crystal of CaS and MgS has been used as the barrier layer material, the use of a mixed crystal of MgS and SrS or of MgS and BaS in place of these materials could also give the same effect as far as they had a composition ratio fulfilling the lattice matching condition.

Similarly, as the phosphor thin film material, a semiconductor material may be selected such that which includes a mixed crystal having a specified composition ratio of ZnS and other IIb–VI group compound semiconductor as its main composition. In such case, by using as the barrier layer material a mixed crystal which keeps lattice matching to the phosphor thin film, a high efficient short-wavelength thin film EL device of a desired wavelength corresponding to the band gap of the phosphor thin film can be obtained similarly to the third embodiment.

Figure 4:
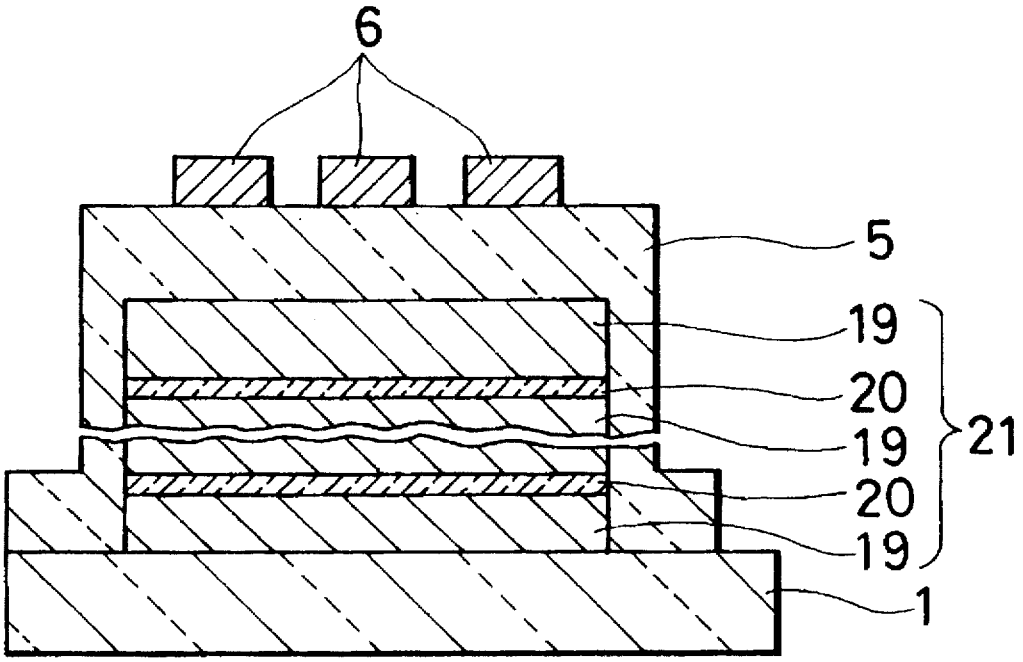
FIG. 4 is a cross-sectional drawing showing a fourth embodiment of a thin film EL device in accordance with the present invention.

The material constitution of a fourth embodiment is elucidated below with reference to FIG. 4. The feature of the present fourth embodiment is to use a compound consisting of manganese and an element of group VI for the barrier layer material. A barrier layer 19 comprising of ZnMnSSe thin film of a thickness of 70 nm was grown on a GaAs substrate 1 by the molecular beam epitaxial evaporation method. Thereover, a phosphor thin film 20 consisting of ZnSe thin film of 10 nm thickness was epitaxially grown. Pairs of this barrier layer 19 and the phosphor thin film 20 were laminated repeatedly by 10 times, and finally a barrier layer 19 was epitaxially grown; thus the laminated light-emitting layer 21 was completed. The composition ratio of these barrier layers 19 was adjusted to a value with which the lattice matches with respect to ZnSe forming the phosphor thin film 20. Thereover, a dielectric thin film 5 of a thickness of 300 nm composed of $BaTa_2O_6$ was formed. Finally a transparent electrode 6 consisting of ITO of a thickness of 200 nm, hence a thin film EL device, was completed. The thin film EL device of the present invention emitted blue light, when it was driven by applying an AC voltage of a pulse width of 30 μs, a repetition frequency of 1 kHz, and a peak voltage of 180 V across the substrate 1 and the transparent electrode 6.

In the fourth embodiment, it is also possible to use CdS:Ag for the phosphor thin film 20 and for the barrier layer ZnMnSe of such a composition ratio that which matches to the lattice of CdS, as a modified embodiment example of combination of a compound of manganese and an element of group VI used for the barrier layer and a material for the phosphor thin film. In that case, InP having a close lattice constant to the above is employed as the substrate material. From an EL device in accordance with the present embodiment elucidated above, a bright red light could be generated.

As another modified embodiment example, ZnCdS:Ag is used In place of the phosphor thin film consisting of ZnSe of the fourth embodiment, and respective layers are formed with such composition ratios that are suitable for achieving the lattice matching between all of substrate, barrier layer and phosphor thin film. Thus a thin film EL device was fabricated. The resultant device delivered bright bluish green light at a specified driving condition.

As for the phosphor thin film material, beside the example of additive of Ag as the luminescent impurity shown in the embodiment, it is also possible to use directly a non-doped ZnCdS or add other luminescent impurity.

Also, by using GaAs, Si or GaP as a substrate 1, using MnS for the barrier layer 19, and using ZnCdS which satisfies the lattice matching condition with MnS as the phosphor thin film 20, thus a thin film EL device having a similar constitution to the above-mentioned embodiment was formed. This device could deliver bright blue light at the specified driving condition.

As still another embodiment example, a thin film EL device having a similar constitution to the above-mentioned embodiment was formed, by using GaSb for the substrate 1, ZnTe for the phosphor thin film 20, and CdMnTe satisfying the lattice matching condition with ZnTe for the barrier layer, respectively. This device could deliver bright green light at the specified driving condition.

Besides the above-mentioned embodiment, as far as by selecting such a combination of a phosphor thin film with a barrier layer that energy gap of the phosphor thin film is smaller than that of the barrier layer and their lattice constants are close to each other, still other materials such as MnTe, MnSe, MnS, or mixed crystals of these with Zn or Cd can be used, and thereby a similar effect to the above-mentioned embodiment is obtainable.

The most stable crystal structure of bulk materials of compounds of Mn and an element of group VI is the rock salt type crystal structure, and it is of different type from zinc blende type crystal structure of the compound semiconductors of elements of group IIb–VI consisting the phosphor thin film used in the above-mentioned embodiments. Some of these compounds, however, take the zinc blende type crystal structure which is the same type crystal structure as that of foundation single crystal substrate of zinc blende type crystal structure as a result of taking a type of mixed crystal with Zn or Cd or making epitaxial growth on a (111)

substrate. The fourth embodiment shows an example wherein the barrier layer and the phosphor thin film have the same zinc blende type crystal structure, and it has a better light-emitting characteristic in comparison with the case that the crystal structure of the afore-mentioned compound of Mn and an element of group VI is different from zinc blende type crystal structure. The reason therefor may be considered that, owing to the realization of a hetero-epitaxy between crystals of the same crystal structure, characteristic of laminated phosphor thin film as a crystal is improved, and thereby the density of crystal defects forming non-radiative centers on the interface is reduced.

Apart from all of the afore-mentioned embodiments, wherein examples uses for their barrier layer the compounds of alkaline earth metals or manganese and an element of group VI, or mixed crystals of these materials, it is also possible to use these materials for the phosphor thin film depending on the necessity. For example, in the second embodiment, beside zinc sulfide including luminescent Impurities for the phosphor thin film material, modified phosphor thin films including calcium sulfide or strontium sulfide as their main composition could also be used. In either cases using these materials, it was necessary to use materials whose energy gaps were greater than that of the phosphor thin films. Likewise, in all of embodiments described above, although examples of employing compounds comprising zinc or cadmium and an element of group VI or mixed crystals of these materials were used for the phosphor thin film, it is also possible to use these materials for the barrier layer material. In those cases also, similar effects were exhibited with an adequate combination wherein the band gap of the barrier layer was greater than that of the phosphor thin film.

According to the present invention, a high light-emissive and high efficiency light-emitting thin film, which can emit the three primary colors, are provided.

In case that a thin film EL device is formed using the light-emitting thin film, a high light-emissive and high efficiency thin film EL device are provided.

And, the present invention is particularly advantageous light-emitting devices for emitting short wavelength light, multicolored EL devices, or full-color EL devices.

Although the present invention has been described in terms of the presently preferred embodiments, it is to be understood that such disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

What is claimed is:

1. A light emission film having a multi-layer structure, comprising:

at least one phosphor film sandwich, each at least one phosphor film sandwich including a phosphor film and first and second barrier layers, said first and second barrier layers being separated by and in contact with said phosphor film, wherein the thickness of said phosphor film is less than 50 nm and larger than 1 nm, and the energy gap of said barrier layers is larger than that of said phosphor film to thereby confine carriers within said phosphor film.

2. The light emission film in accordance with claim 1, wherein said multi-layer structure further comprises at least one additional phosphor film sandwich.

3. The light emission film in accordance with claim 1 or 2, wherein said barrier layers contain at least one chemical compound selected from the group consisting of chemical compounds of zinc, cadmium, manganese and alkaline earth metals together with elements from group VI.

4. The light emission film in accordance with claim 1 or 2, wherein said barrier layers contain at least one chemical compound selected from the group consisting of fluorides of alkaline earth metals.

5. The light emission film in accordance with claim 1 or 2, wherein both said phosphor film and said barrier layers have the same crystal structure.

6. The light emission film in accordance with claim 1 or 2, wherein at least one of said phosphor film and said barrier layers contains the chemical compound of magnesium sulfide and at least one chemical compound selected from the group consisting of the chemical compounds of other sulfides of alkaline earth metals.

7. The light emission film in accordance with claim 3, wherein said chemical compounds of manganese and elements of group VI contain at least one chemical compound selected from the group consisting of manganese telluride (MnTe), manganese selenide (MnSe), and manganese sulfide (MnS).

8. The light emission film in accordance with claim 3, wherein said chemical compounds selected from the group of chemical compounds of manganese and one of the elements of group VI have a zinc-blend crystal structure.

9. The light emission film in accordance with claim 1 or 2, wherein said phosphor film and barrier layer are epitaxial films.

10. The light emission film in accordance with claim 1 or 2, Wherein said light emission film is for use in a thin film electroluminescent device adapted to apply a voltage to said light emission film.

11. The light emission film in accordance with claim 10, wherein a dielectric film is formed at least on one surface of said light emission film, and in contact with the first barrier layer of said at least one phosphor film sandwich of said multi layer structure, to receive the voltage applied to said light emission film by the thin film electroluminescent device.

12. The light emission film in accordance with claim 1 or 2, wherein a plurality of phosphor film sandwiches are stacked such that adjacent interfaces of adjacent sandwiches share a common barrier layer interposed therebetween.

13. A light emission film having a multi-layer structure, comprising:

at least one phosphor film sandwich, each at least one phosphor film sandwich including a phosphor film and first and second barrier layers, said first and second barrier layers being separated by and in contact with said phosphor film, wherein the thickness of said phosphor film is less than 50 nm and larger than 1 nm, and the energy gap of said barrier layers is larger than that of said phosphor film to thereby confine carriers within said phosphor film, and said phosphor film contains at least one chemical compound selected from the group consisting of chemical compounds of zinc, cadmium, manganese and alkaline earth metals together with elements from group VI.

14. The light emission film according to claim 13, wherein said barrier layers have a band gap energy exceeding 3.5 eV.

15. The light emission film according to claim 13, wherein said barrier layers have a band gap energy of 3.8 to 5.4 eV.

* * * * *